US006705227B2

(12) United States Patent
Becker

(10) Patent No.: US 6,705,227 B2
(45) Date of Patent: Mar. 16, 2004

(54) RECTO AND VERSO PRINTING PRESS HAVING UPPER AND LOWER GRIPPERS AND GRIPPER PAD WITH COMMON CENTER LINE

(75) Inventor: Willi Becker, Bammental (DE)

(73) Assignee: Heidleberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/252,998

(22) Filed: Sep. 23, 2002

(65) Prior Publication Data

US 2003/0056670 A1 Mar. 27, 2003

(30) Foreign Application Priority Data

Sep. 21, 2001 (DE) ..... 101 46 637

(51) Int. Cl.[7] ..... B41F 21/04; B41F 21/10

(52) U.S. Cl. ..... 101/409; 101/230; 101/246; 271/277

(58) Field of Search ..... 101/229, 230, 101/231, 232, 246, 409, 410, 411; 271/277

(56) References Cited

U.S. PATENT DOCUMENTS

| | | | | |
|---|---|---|---|---|
| 4,101,122 A | | 7/1978 | Jeschke et al. | 281/277 |
| 4,700,626 A | | 10/1987 | Iwamoto et al. | 101/230 |
| 5,762,333 A | * | 6/1998 | Sugiyama et al. | 271/276 |
| 6,263,794 B1 | | 7/2001 | Haupenthal | 101/409 |

FOREIGN PATENT DOCUMENTS

| | | |
|---|---|---|
| DE | 24 14 998 B2 | 10/1975 |
| DE | 36 05 523 C2 | 8/1987 |
| DE | 199 27 695 A1 | 1/2000 |
| DE | 100 52 145 A1 | 5/2001 |

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A recto and verso printing press, comprising an upper gripper and a lower gripper, respectively, centrally pivotable with respect to an introduction of force, said upper gripper, in recto printing position thereof, being cooperable with a gripper pad fixed to a cylinder of the printing press, said upper gripper and said lower gripper being arranged centrally in relation to one another and to said gripper pad, and having a common center line.

17 Claims, 5 Drawing Sheets

RECTO AND VERSO PRINTING PRESS HAVING UPPER AND LOWER GRIPPERS AND GRIPPER PAD WITH COMMON CENTER LINE

BACKGROUND OF THE INVENTION

Field of the Invention

The invention relates to a recto and verso printing press. A recto and verso printing press of the general type according to the invention described herein has been disclosed in the published German Patent Document DE 3605523 C2. The printing press possesses a turning device having grippers which are arranged on a gripper shaft in a turning drum and can be changed over from recto or first-form printing to recto and verso or first-form and perfecter printing. In recto printing, the sheet to be printed is clamped between a fixed gripper pad and a main gripper. In verso printing, in order to pick up the trailing edge of the sheet, the main gripper, together with an auxiliary gripper arranged at the side of the main gripper, pivots towards the trailing edge of the sheet and clamps the latter between the auxiliary gripper and the main gripper, which has been widened on one side. After a returning pivoting movement towards the gripper pad, the sheet to be printed is placed on the pad again, clamped by the main gripper, and the auxiliary gripper is lowered into a waiting position.

A considerable disadvantage of the heretoforeknown turning device is that, as the auxiliary gripper is closed in relation to the main gripper, there is an introduction of force which is off-center relative to the main gripper support, causing a tilting of the main gripper (due to shaft play). After the return pivoting and the placement of the sheet on the gripper pad, the introduction of force changes from the center of the auxiliary gripper to the center of the pad.

A result thereof is a return or backward tilting. The continuous alternating tilting leads firstly to increased wear on the bearing points and secondly to register problems, because the clamped sheets are also tilted and therefore stressed.

SUMMARY OF THE INVENTION

Starting from the aforementioned prior art, it is an object of the invention to provide a tilt-free gripper arrangement which, both in recto printing and in verso printing, operates with register-maintaining transfer and avoids premature wear, as much as possible.

With the foregoing and other objects in view, there is provided, in accordance with the invention, a recto and verso printing press, comprising an upper gripper and a lower gripper, respectively, centrally pivotable with respect to an introduction of force, the upper gripper, in recto printing position thereof, being cooperable with a gripper pad fixed to a cylinder of the printing press, the upper gripper and the lower gripper being arranged centrally in relation to one another and to the gripper pad, and having a common center line.

In accordance with another feature of the invention, the upper and the lower gripper are shaft-mounted, and the upper gripper and the lower gripper, respectively, are arranged on separate gripper supports, the gripper supports being positioned coaxially to one another.

In accordance with a further feature of the invention, the upper gripper support is of annular construction, and the lower gripper support is constructed as a solid shaft and is mounted concentrically with respect to the upper gripper support.

In accordance with an added feature of the invention, the upper gripper is actable upon the upper gripper support, and the lower gripper is actable upon the solid shaft serving as the lower gripper support and being mounted within the upper gripper support.

In accordance with an additional feature of the invention, the upper gripper support is mounted on a tube enclosing the solid shaft serving as the lower gripper support concentrically, with an annular gap being defined therebetween.

In accordance with yet another feature of the invention, the recto and verso printing press further comprises a plurality of sliding bearings arranged in axial distribution in the annular gap for mounting the lower gripper support formed as the solid shaft.

In accordance with yet a further feature of the invention, the lower gripper is threadedly secured to the solid shaft serving as said lower gripper support, via a connection part attached radially to the lower gripper support, and the connection part, with the lower gripper integrally molded on an outer end thereof, being guided outwardly through a radial slot formed in the upper gripper support.

In accordance with yet an added feature of the invention, the tube arranged between the upper gripper support and the lower gripper support is also formed with at least one radial slot through which one of the lower gripper and the connection part connected thereto extends.

In accordance with yet an additional feature of the invention, the upper gripper support comprises two axially spaced cheeks which are permanently connected to one another.

In accordance with still another feature of the invention, the recto and verso printing press further comprises a stop threadedly secured to the tube and being arranged axially between the two cheeks of the upper gripper support for limiting a pivoting movement of the upper gripper.

In accordance with still a further feature of the invention, the stop is formed with a flange thereon which serves for cooperating with the connection of the upper gripper support.

In accordance with still an added feature of the invention, the recto and verso printing press further comprises a compression spring disposed between the connection of the upper gripper support and the flange of the stop, the compression spring serving for generating a clamping force of the upper gripper.

In accordance with still an additional feature of the invention, the stop has a further flange, and an adjusting screw is threadedly secured therein, the adjusting screw serving for cooperating with the connection of the upper gripper support.

In accordance with another feature of the invention, the lower gripper is of fork-like construction and, in lowered position, encloses the gripper pad on both sides.

In accordance with a further feature of the invention, the gripper pad is of fork-like construction and has two fork prongs.

In accordance with an added feature of the invention, the lower gripper is of fork-like construction with three spaced fork prongs, and engages with the central fork prong thereof in a depression formed between the two fork prongs of the gripper pad and, with the two outer fork prongs thereof, encloses the gripper pad laterally.

In accordance with a concomitant feature of the invention, the lower gripper has a narrow shape and, overall, the two fork prongs of said gripper pad engage laterally around the lower gripper.

As a result of the central, centric association of all the gripper parts in relation to one another and to the gripper pad according to the invention, tilting is prevented, and wear and register faults are avoided.

By the novel arrangement of the fork prongs, an advantage is provided that a plurality of format widths of the sheet can be gripped, at least by one fork prong, and, therefore, exposed corners can be held as briefly as possible. The result is fewer turned-over or dog-eared corners, which could be produced by the wind resulting from travel movement during return pivoting. Furthermore, the aforementioned advantage permits a higher rotary speed of the printing press.

Other features which are considered as characteristic for the invention are set forth in the appended claims.

Although the invention is illustrated and described herein as embodied in a recto and verso printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
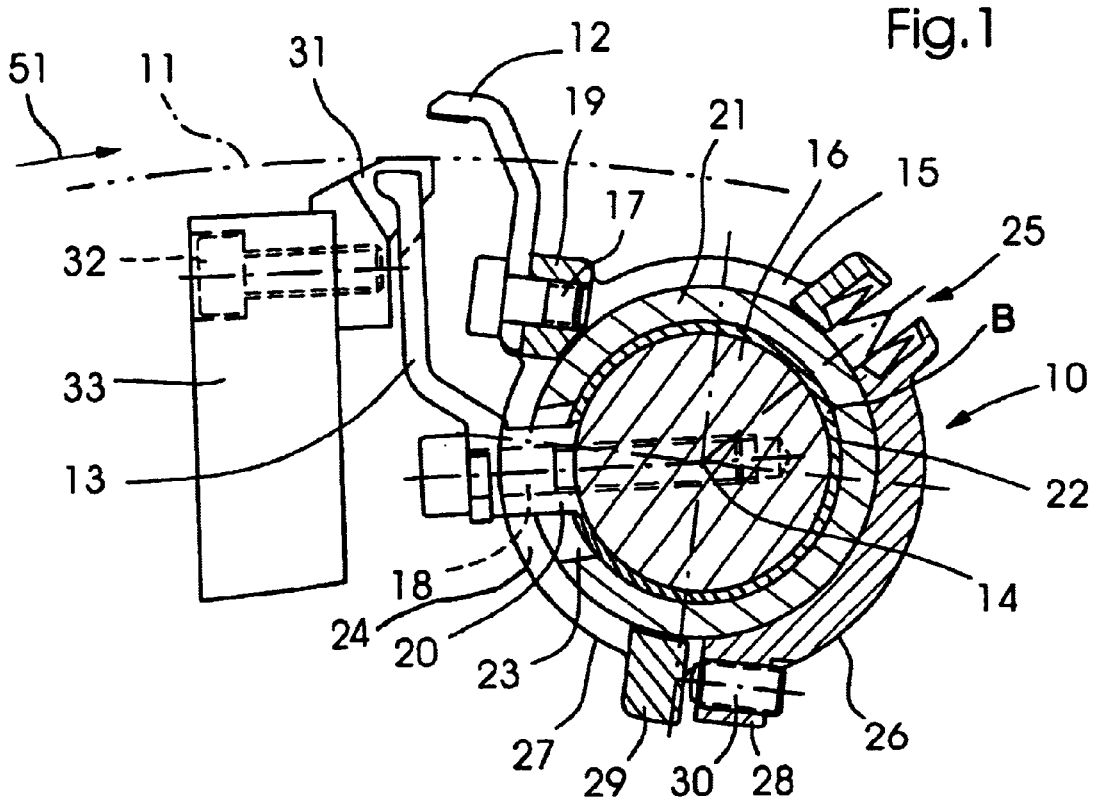
FIG. 1 is a cross-sectional view of an embodiment of a gripper arrangement, in open position, comprising an upper and a lower gripper for a recto and verso printing press.

Referring now to the drawings and, first, particularly to FIGS. 1 to 5 and 10, thereof, it is noted that a gripper arrangement overall identified by reference numeral 10 is provided on a turning drum 11 represented only fragmentarily and in phantom. The gripper arrangement 10 has an upper gripper 12 and a lower gripper 13, which are mounted so that they can be pivoted about a common axis 14 lying parallel to the non-illustrated axis of rotation of the turning drum 11. A significant special feature here resides in the fact that the upper gripper 12 and the lower gripper 13 act upon two gripper supports 15 and 16 mounted concentrically with respect to one another on the turning drum 11. The upper gripper support 15, which bears the upper gripper 12, is of approximately annular construction, and the lower gripper support 16, which bears the lower gripper 13, is constructed as a solid shaft. The upper gripper support 15 bearing the upper gripper 12 is mounted on a tube 21 which has a radial spacing (note the annular gap 22) from the lower gripper support 16, i.e., the solid shaft. In the annular gap 22, a plurality of axially distributed sliding bearings B are seated for mounting the solid shaft 16 in the tube 21.

The upper gripper 12 and the lower gripper 13 are connected to the respective gripper supports 15 and 16 by cheese-head screws 17 and 18, respectively. The upper gripper 12 is screwed onto the upper gripper support 15 by a connecting part 19 integrally molded radially/tangentially on the outer circumference of the upper gripper support 15, while the lower gripper 13 has a connecting part 20 connected thereto integrally, which acts radially on the circumference of the lower gripper support 16 (the solid shaft) via the cheese-head screw 18. The connecting part 20, and therefore also the lower gripper 13, projects outwardly through radial slots 23 and 24 formed in the tube 21 and the upper gripper support 15, respectively. This permits the two grippers 12 and 13 to pivot relative to one another about the common axis 14.

Figure 10:
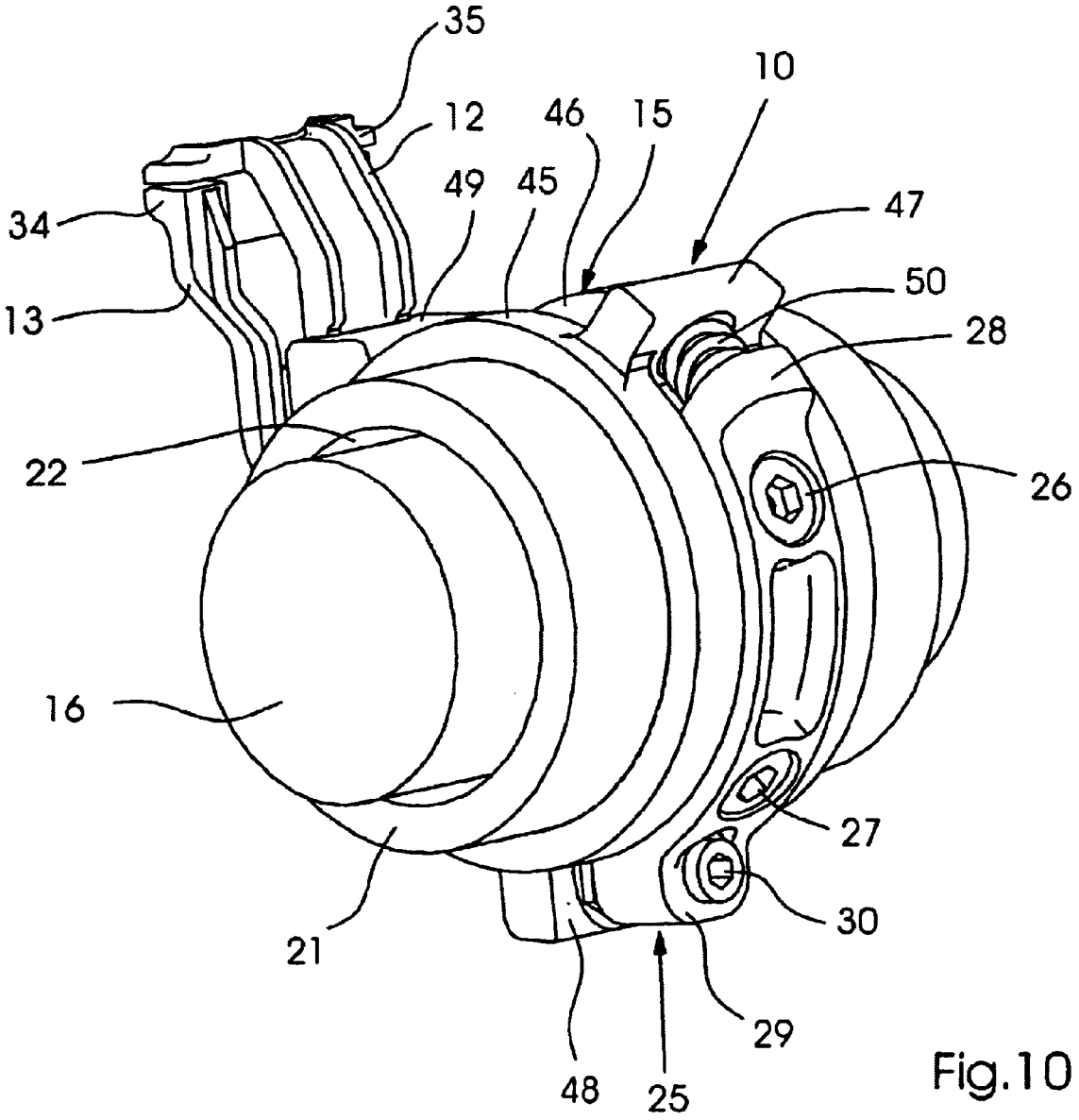
FIG. 10 is a perspective view of the gripper arrangement according to FIGS. 1 and 2.

As is believed to be apparent in particular from FIG. 10, the upper gripper support 15 is made up of two axially spaced annular cheeks 45 and 46, which are permanently connected to one another at three locations 47, 48 and 49.

Situated axially between the two cheeks 45 and 46 of the upper gripper support 15 is a partially annular stop 25, which is permanently connected to the tube 21 by two screws 26 and 27. The stop 25 serves for limiting the pivoting movement of the upper gripper 12. For this purpose, the stop 25 has a flange 28, which cooperates with the connection location 47. A compression spring 50 arranged between the connection location 47 and the flange 28 serves for producing the clamping force of the upper gripper 12.

At the other or lower end of the stop 25, a further flange 29 is formed, into which an adjusting screw 30 is screwed, which cooperates with the connection location 48 on the upper gripper support 15. The adjusting screw 30 serves for adjusting the opening and closing times, respectively, of the grippers 12 and 13.

Figure 2:
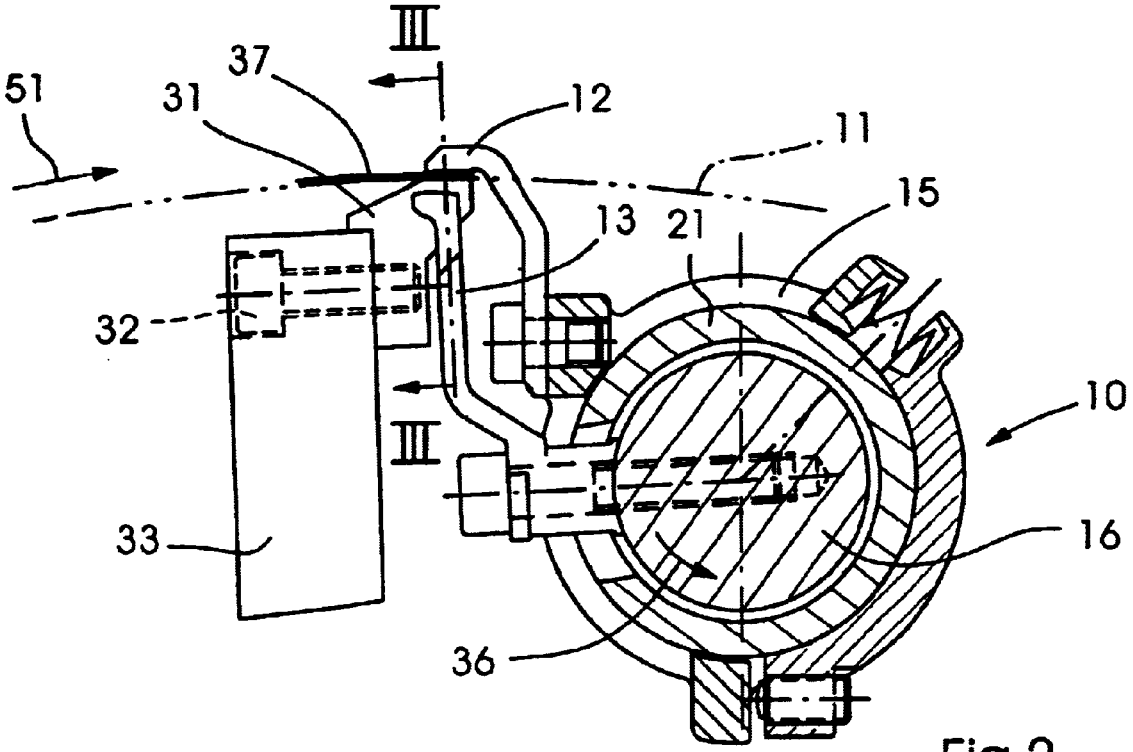
FIG. 2 is a view like that of FIG. 1, showing the upper gripper cooperating with a gripper pad fixed to a cylinder, but the lower gripper still being in the lowered or rest position, in recto printing operation and after return pivoting, respectively.

The gripper arrangement resulting in particular from FIGS. 1, 2 and 10 is overall rotatably mounted at a plurality of non-illustrated bearing locations arranged axially in relation to one another.

Figure 3:
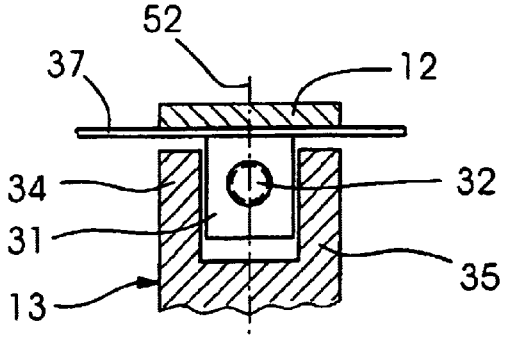
FIG. 3 is a sectional view of FIG. 2, taken along the line III—III in the direction of the arrows.
Figure 4:
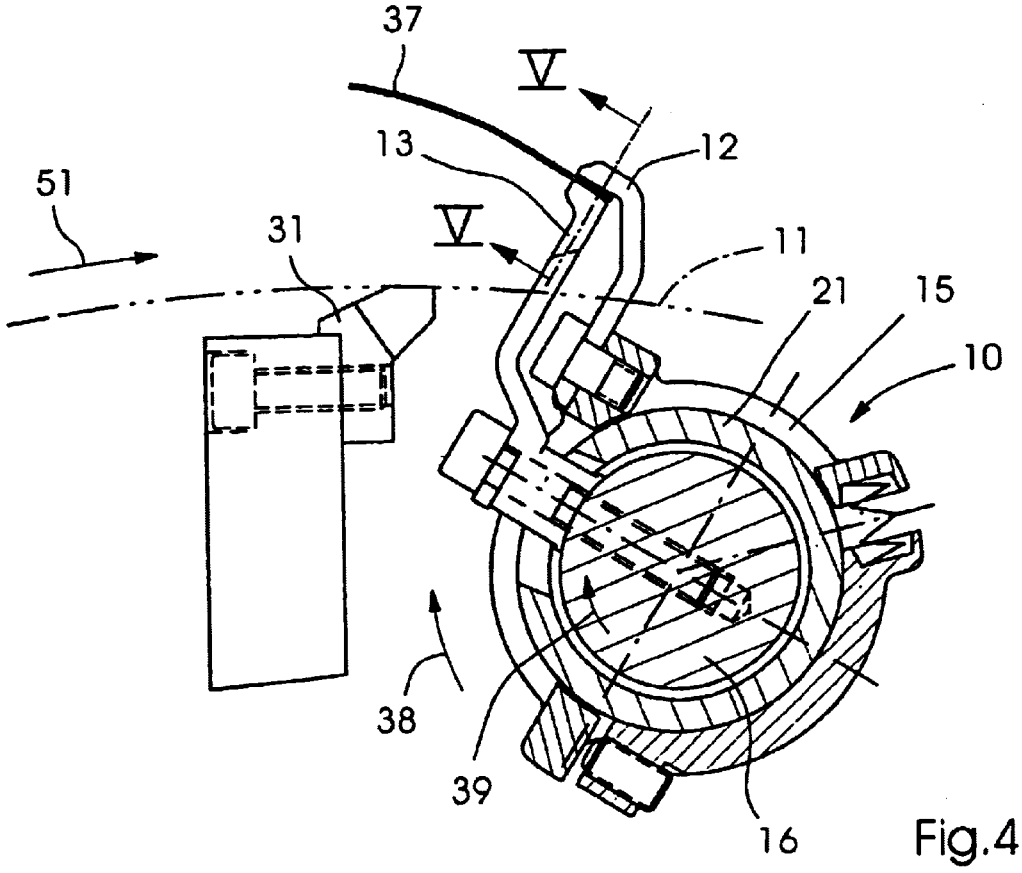
FIG. 4 is another view like those of FIGS. 1 and 2, in the closed position of the upper and lower grippers (during the return pivoting phase of the gripper arrangement)
Figure 5:
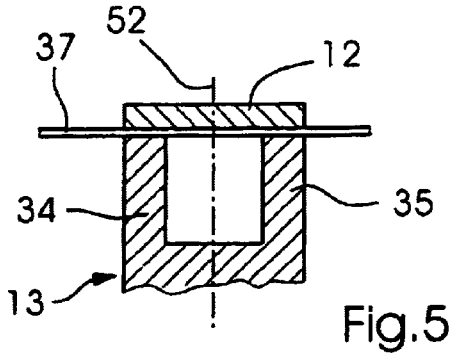
FIG. 5 is a sectional view of FIG. 4, taken along the line V—V in the direction of the arrows.

The upper gripper 12 is provided for cooperating with the lower gripper 13, conceived and arranged appropriately (note the gripper position in FIGS. 4 and 5). The upper gripper 12, however, also cooperates with a gripper pad 31 (note the gripper position according to FIGS. 2 and 3). The gripper pad 31 is fixed by a screw 32 to a pad holder 33, which is permanently connected to the turning drum 11.

In the gripper position according to FIGS. 2 and 3, which is assumed in the recto printing operation of the press, the lower gripper 13 which, as FIGS. 3 and 10 show, is of fork-like construction and has two fork prongs 34 and 35, is located in the lowered position as a result of a corresponding rotation of the second shaft 16 in the direction of the arrow 36 (note FIG. 2). In this regard, the fork prongs 34 and 35 of the lower gripper 13 engage laterally around the gripper pad 31 (note FIG. 3). A sheet 37 is shown disposed on the turning drum 11 and, in this case, is held thereon by being clamped between the upper gripper 12 and the gripper pad 31.

FIGS. 4 and 5 illustrate the last phase of the return pivoting movement of the gripper arrangement 10 before the turning operation of the sheet 37 has been completed. The gripper arrangement 10 had previously carried out a pivoting movement through about 160° in clockwise direction, as shown by arrow 38 and, in this position between the upper gripper 12 and the lower gripper 13, had picked up the trailing end of the sheet 37 from a non=illustrated preceding cylinder rotating in counterclockwise direction, in order to transfer the sheet 37 to the turning drum 11 rotating in clockwise direction, i.e., the direction of the arrow 51, as can be seen from FIG. 2. The sheet turning operation, as such, is otherwise heretofore known prior art in recto and verso printing presses, so that providing a detailed outline of the turning operation herein is believed to be superfluous.

In order to attain the closed position of the gripper arrangement 10 illustrated in FIGS. 4 and 5, wherein, as opposed to the open position of the gripper arrangement 10 according to FIGS. 2 and 3, the lower gripper 13 has been pivoted to such an extent that it cooperates with the upper gripper 12, the (inner) solid shaft 16, i.e., the lower gripper support, which bears the lower gripper 13, must have been pivoted through an appropriate angle, in the direction of arrow 39, relative to the upper gripper support 15 connected to the upper gripper 12.

Figure 6:
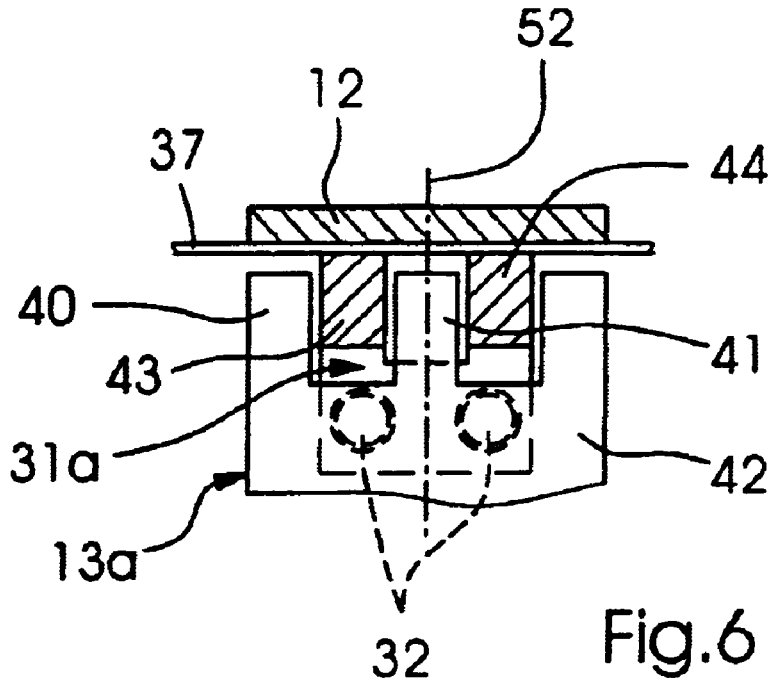
FIG. 6 is a sectional view corresponding to that of FIG. 3 (recto printing operation) of a different embodiment of the gripper arrangement, which has been modified with respect to the embodiment according to FIGS. 3 and 5 in that it has a three-prong/fork-like lower gripper and a two-prong/fork-like gripper pad.
Figure 7:
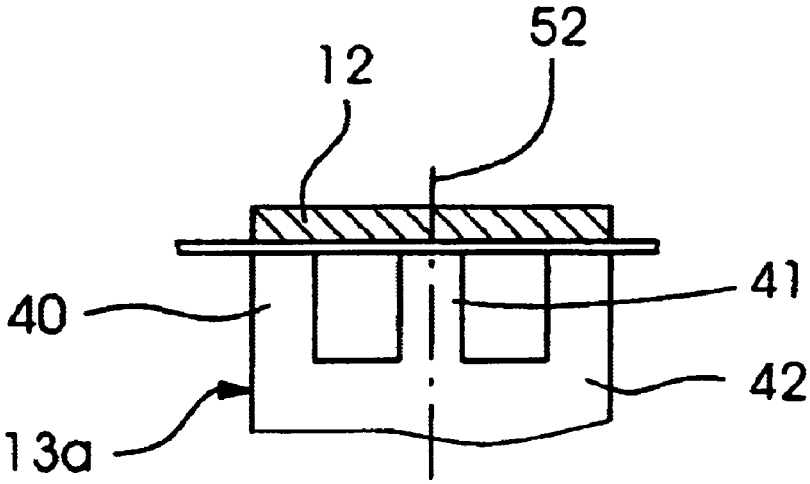
FIG. 7 shows the gripper arrangement of FIG. 6 in a sectional view corresponding to that of FIG. 5 (return pivoting phase)

In the embodiment according to FIGS. 6 and 7, the special feature is provided by the lower gripper 13*a* having three fork prongs 40, 41 and 42, and also the gripper pad 31*a* being of fork-like construction, but only having two fork prongs 43 and 44. On the other hand, the upper gripper 12 corresponds to the embodiment according to FIGS. 1 to 5.

Figure 8:
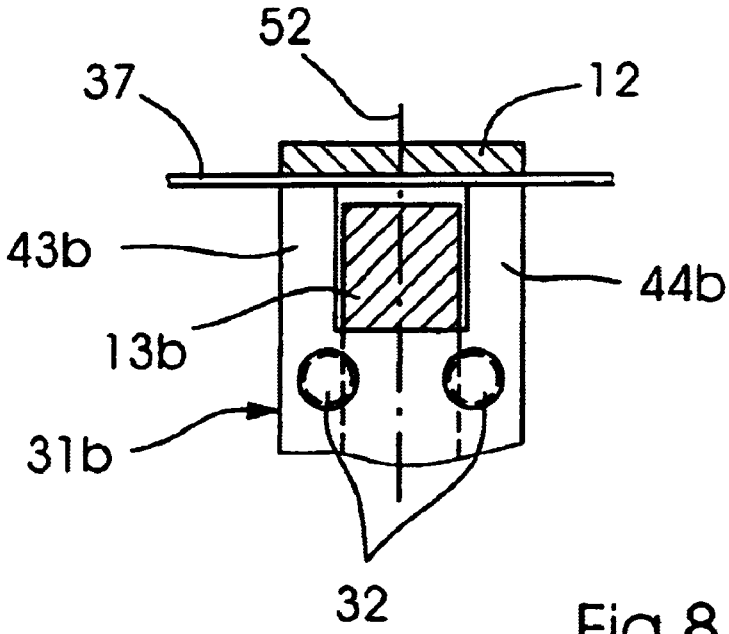
FIG. 8 is a sectional view corresponding to those of FIG. 3 or FIG. 6 (recto printing operation) of a further embodiment of the gripper arrangement having a two-prong/fork-like gripper pad and narrow lower gripper.
Figure 9:
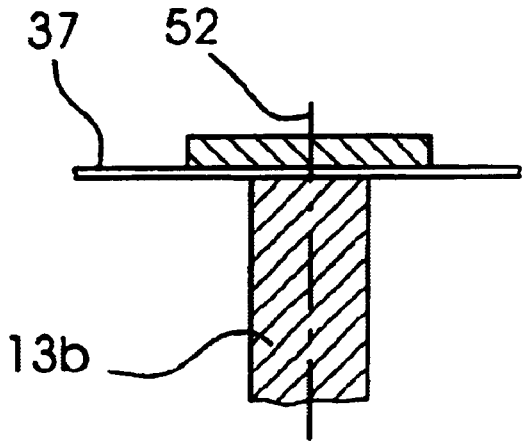
FIG. 9 is a sectional view of the gripper arrangement of FIG. 8 corresponding to those of FIG. 5 and FIG. 7 (return pivoting phase)

The embodiment according to FIGS. 8 and 9 differs from the embodiments described hereinbefore with respect to the special feature thereof in that, although the gripper pad 31*b* is of fork-like/two-pronged construction, similar to that in the embodiment according to FIGS. 6 and 7, the lower gripper 13*b* has a narrow shape, so that in the lowered position thereof shown in FIG. 8, wherein the sheet 37 is clamped between the upper gripper 12 and the gripper pad 31*b*, both of the fork prongs 43*b* and 44*b* engage laterally around the lower gripper 13*b*.

In particular, FIGS. 3, 5, 6, 7, 8 and 9 show that the gripper elements, such as the upper gripper, the lower gripper and the gripper pad, have a common center line 52. Due to this feature, tilting, wear and register faults are prevented.

In this case, the common center line 52 extends perpendicularly to the axis of the gripper shaft.

I claim:

1. A recto and verso printing press, comprising an upper gripper and a lower gripper, respectively, centrally pivotable with respect to an introduction of force, said upper gripper, in recto printing position thereof, being cooperable with a gripper pad fixed to a cylinder of the printing press, said upper gripper and said lower gripper being arranged centrally in relation to one another and to said gripper pad, and having a common center line.

2. The recto and verso printing press according to claim 1, wherein said upper and said lower gripper are shaft-mounted, and said upper gripper and said lower gripper, respectively, are arranged on separate gripper supports, said gripper supports being positioned coaxially to one another.

3. The recto and verso printing press according to claim 2, wherein said upper gripper support is of annular construction, and said lower gripper support is constructed as a solid shaft and is mounted concentrically with respect to said upper gripper support.

4. The recto and verso printing press according to claim 3, wherein said upper gripper is actable upon said upper gripper support, and said lower gripper is actable upon said solid shaft serving as said lower gripper support and being mounted within said upper gripper support.

5. The recto and verso printing press according to claim 3, wherein said upper gripper support is mounted on a tube enclosing said solid shaft serving as said lower gripper support concentrically, with an annular gap being defined therebetween.

6. The recto and verso printing press according to claim 5, further comprising a plurality of sliding bearings arranged in axial distribution in said annular gap for mounting said lower gripper support formed as said solid shaft.

7. The recto and verso printing press according to claim 3, wherein said lower gripper is threadedly secured, to said solid shaft serving as said lower gripper support, via a connection part attached radially to said lower gripper support, and said connection part, with said lower gripper integrally molded on an outer end thereof, being guided outwardly through a radial slot formed in said upper gripper support.

8. The recto and verso printing press according to claim 5, wherein said tube arranged between said upper gripper support and said lower gripper support is also formed with at least one radial slot through which one of said lower gripper and said connection part connected thereto extends.

9. The recto and verso printing press according to claim 3, wherein said upper gripper support comprises two axially spaced cheeks which are permanently connected to one another at a plurality of connection points.

10. The recto and verso printing press according to claim 9, further comprising a stop threadedly secured to said tube and being arranged axially between said two cheeks of said upper gripper support for limiting a pivoting movement of said upper gripper.

11. The recto and verso printing press according to claim 10, wherein said stop is formed with a flange thereon which serves for cooperating with one of said connection points of said upper gripper support.

12. The recto and verso printing press according to claim 11, further comprising a compression spring disposed between said one of said connection points of said upper gripper support and said flange of said the stop, said compression spring serving for generating a clamping force of said upper gripper.

13. The recto or verso printing press according to claim 10, wherein said stop has a further flange, and wherein an adjusting screw is threadedly secured therein, said adjusting screw serving for cooperating with said connection of said upper gripper support.

14. The recto and verso printing press according to claim 1, wherein said lower gripper is of fork-like construction and, in lowered position, encloses said gripper pad on both sides.

15. The recto and verso printing press according to claim 1, wherein said gripper pad is of fork-like construction and has two fork prongs.

16. The recto and verso printing press according to claim 15, wherein said lower gripper is of fork-like construction with three spaced fork prongs, and engages with the central fork prong thereof in a depression formed between said two fork prongs of said gripper pad and, with said two outer fork prongs thereof, encloses said gripper pad laterally.

17. The recto and verso printing press according to claim 15, wherein said lower gripper has a narrow shape and, overall, said two fork prongs of said gripper pad engage laterally around said lower gripper.

* * * * *